US009791139B2

(12) United States Patent
Van Delden et al.

(10) Patent No.: US 9,791,139 B2
(45) Date of Patent: Oct. 17, 2017

(54) SAFE OPERATION OF AN LED LAMP

(71) Applicant: PHILIPS LIGHTING HOLDING B.V., Eindhoven (NL)

(72) Inventors: Martinus Hermanus Wilhelmus Maria Van Delden, Eidenhoven (NL); Reinier Imre Anton Den Boer, Eidenhoven (NL); Siebe-Jan Van Der Hoef, Eidenhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/116,519

(22) PCT Filed: Feb. 3, 2015

(86) PCT No.: PCT/EP2015/052221

§ 371 (c)(1),
(2) Date: Aug. 4, 2016

(87) PCT Pub. No.: WO2015/117969

PCT Pub. Date: Aug. 13, 2015

(65) Prior Publication Data

US 2016/0356473 A1 Dec. 8, 2016

(30) Foreign Application Priority Data

Feb. 7, 2014 (EP) ..... 14154333

(51) Int. Cl.
*F21V 25/04* (2006.01)
*H05B 33/08* (2006.01)
(Continued)

(52) U.S. Cl.
CPC ..... *F21V 25/04* (2013.01); *F21K 9/20* (2016.08); *F21V 3/0418* (2013.01);
(Continued)

(58) Field of Classification Search
None
See application file for complete search history.

(56) References Cited

U.S. PATENT DOCUMENTS 9,184,004 B2 * 11/2015 Gentsch ..... H01H 9/54
2005/0083165 A1 4/2005 Tirmizi
(Continued)

FOREIGN PATENT DOCUMENTS

DE 10250968 A1 5/2004
EP 0863528 A2 9/1998
(Continued)

OTHER PUBLICATIONS

C. Mathas, "Electronic Fuses Delivery LED Lighting Overcurrent Protection", www.edn.com, Oct. 21, 2013, two pages.

*Primary Examiner* — Douglas W Owens
*Assistant Examiner* — James H Cho
(74) *Attorney, Agent, or Firm* — Akarsh P. Belagodu

(57) ABSTRACT

A lamp and an operating method for a lamp with an LED element 22 are described. An electrical circuit with the LED element 22 is covered by a cover member 12. A separation device 28 is provided to mechanically severe the electrical conductor 16*a*, 16*b* arrange to supply electrical power to the LED element 22 if the detector element 24 detects a defect of the cover member 12.

7 Claims, 4 Drawing Sheets

(51) Int. Cl.

| | |
|---|---|
| ***H01H 39/00*** | (2006.01) |
| ***F21K 9/20*** | (2016.01) |
| ***F21V 3/04*** | (2006.01) |
| ***F21V 23/00*** | (2015.01) |
| *F21Y 115/10* | (2016.01) |

(52) U.S. Cl.
CPC ..... *F21V 23/005* (2013.01); *H01H 39/006* (2013.01); *H05B 33/0809* (2013.01); *H05B 33/0887* (2013.01); *F21Y 2115/10* (2016.08)

(56) References Cited

U.S. PATENT DOCUMENTS

| | | | | |
|---|---|---|---|---|
| 2005/0253533 | A1* | 11/2005 | Lys | H05B 33/0815 315/224 |
| 2009/0230309 | A1* | 9/2009 | Kohda | G01T 1/24 250/370.09 |
| 2012/0194077 | A1 | 8/2012 | Wei et al. | |
| 2013/0249401 | A1 | 9/2013 | Kato et al. | |
| 2014/0028197 | A1* | 1/2014 | van de Ven | H05B 33/0872 315/150 |
| 2015/0035439 | A1* | 2/2015 | Nittke | H05B 37/03 315/127 |

FOREIGN PATENT DOCUMENTS

| | | | |
|---|---|---|---|
| JP | 2010118267 | A | 5/2010 |
| WO | WO2011027278 | A1 | 3/2011 |

* cited by examiner

SAFE OPERATION OF AN LED LAMP

CROSS-REFERENCE TO PRIOR APPLICATIONS

This application is the U.S. National Phase application under 35 U.S.C. §371 of International Application No. PCT/EP2015/052221, filed on Feb. 3, 2015, which claims the benefit of European Patent Application No. 14154333.0, filed on Feb. 7, 2014. These applications are hereby incorporated by reference herein.

FIELD OF THE INVENTION

The invention relates to a lamp and to a method of operating a lamp. In particular, the invention relates to a lamp including an LED element.

BACKGROUND OF THE INVENTION

Due to their known advantages such as high energy efficiency, small size and long lifetime, LEDs are increasingly used today in lighting and signaling applications. Retrofit LED lamps are replacing other technologies such as incandescent lamps or fluorescent lamps.

Such LED lamps are designed safe for the user, i.e. any life electrical parts, such as the electrical circuit comprising the LED element, are covered, so that a direct contact with the operating voltage, which could result in an electric shock, is prevented in normal operation and handling of the LED lamp. However, problems may arise if the LED lamp is damaged.

WO 2011/027278 A1 describes an LED lamp with at least one LED in a housing. An isolation monitoring device determines a defect of the housing and in this case disconnects the LED from power. The isolation monitoring device may comprise a detection circuit integrated with the housing, or a pressure sensor to detect a defect. Switches may be provided for all-pole disconnection of the LED, or to short-circuit a fuse for permanently disconnecting the LED from power.

SUMMARY OF THE INVENTION

It may be considered an object to provide an LED lamp with increased safety even in case of damage.

This object is achieved by an LED lamp according to claim 1 and by an operating method according to claim 14. Dependent claims refer to preferred embodiments of the invention.

An LED lamp according to the invention comprises an electrical circuit which includes at least one LED element. This comprises single elements as well as arrays of any type of solid state lighting elements, including light emitting diodes and organic light emitting diodes (OLED).

The lamp further comprises a cover member. The cover member is provided to cover at least a part of the electrical circuit in order to provide protection for a user to handle the lamp without a danger of electrical shock from touching life parts, i.e. parts of the circuit energized with operating voltage. The cover member may preferably be a housing provided to fully isolate the electrical circuit (except for supply terminals).

The electrical circuit of the lamp comprises at least one electrical conductor, which is arranged to supply electrical power to the LED element. According to the invention, the lamp comprises a separation device provided to mechanically server the conductor if a detector element detects a defect of the cover member.

The detector element allows to distinguish between a normal state of the lamp which allows safe operation, and a defect state, where at least a part of the cover member may be broken, opened, missing or otherwise comprise a defect which may present a danger that it does no longer fulfill the function of securely isolating any life parts of the electrical circuit. In particular, the detector element may detect mechanical damage to the cover member.

In case of a defect detected by the detector element, the electrical conductor arranged in the supply line of electrical power to the LED element is mechanically severed, i.e. electrically conducting material of the electrical conductor, such as preferably metal material, is e. g. cut, ripped apart or otherwise mechanically acted upon so that the material is permanently separated and no further electrical conduction is possible. Thus, supply of further electrical power is permanently disrupted and any further operation of the LED element is permanently inhibited.

By mechanically severing the electrical conductor, and thus permanently disconnecting the LED element, unsafe operation is avoided. Permanent disconnection ensures that in cases of a defect of a cover member, e. g. a broken housing, the LED lamp is permanently disabled and must be exchanged.

According to a preferred embodiment of the invention, the separation device may comprise an impulse element suited to be triggered to provide a motion force for severing the electrical conductor. The impulse element may be any element suited to provide the required force if triggered. A mechanical member may be propelled by the motion force for severing the electrical conductor. As will become apparent in connection with preferred embodiments, the propelled mechanical member may be a part of a carrier (e. g. circuit board) on which the electrical conductor is provided, or may be a separate element arranged to mechanically act on the electrical conductor.

According to a preferred embodiment, the impulse element may be provided to be electrically triggered. The electrical signal provided as a trigger may serve to deliver the energy for providing the motion force. Alternatively, the electrical trigger signal may serve to release pre-stored energy e. g. in electrical, chemical or mechanical form.

In a particularly preferred embodiment, an electrical triggering signal may be provided through a triggering conductor, which is electrically isolated from the electrical conductor to the LED element. Thus, preferably, the electrical triggering signal is not conducted through the electrical conductor itself, but separately through a triggering conductor.

In embodiments of the invention, different elements may serve to provide a motion force for severing the electrical conductor. For example, a chemical charge may be provided, which, if triggered, propels a mechanical member. Alternatively, a spring element may be provided with pre-stored mechanical energy, which is released if triggered, e. g. by removing a lock element. Further, it is possible to provide a driving coil to electromagnetically propel a ferromagnetic element. Alternative embodiments and combinations of the above described embodiments are also possible.

Preferably, the electrical conductor may be a bond wire. Wire bonding is a flexible and cost-effective interconnect technology widely used on an industrial scale in semiconductor packaging. A bond wire may in particular consist of aluminum, copper or gold with diameters of 15 μm to several hundred μm. In particular preferred are diameters of 30 μm-100 μm. A bond wire is well suited to permanently interrupt the power supply if severed. Due to its small dimensions, it may be easily cut, ripped apart or otherwise severed.

According to a preferred embodiment of the invention, the electrical conductor may be provided on a first carrier part and on a second carrier part. The carrier parts may be any element suited to mechanically hold the electrical conductor. In particular, the carrier parts may be parts of one or more circuit board. The electrical conductor may then be severed by separating the first and second carrier parts. The electrical conductor between the carrier parts then breaks, such that the desired mechanical separation is effected.

In one embodiment of the invention, a plurality of breakage zones are arranged along the length of the electrical conductor, i.e. electrically in series. The separation device may server the electrical conductor not only in a single location, but may act such that the conductor is severed at least in two of the breakage zones. Due to the sequential arrangement of the breakage zones and the resulting electrical series connection, this ensures electrical isolation even in case that separation in one of the breakage zones may be incomplete.

The lamp may comprise electrical terminals, where it is connected to a supply of electrical operating power, e.g. from a lighting fixture, ballast, mains connection etc. A rectifier circuit and a driver circuit may be arranged electrically between the LED element and the electrical terminals, such that AC electrical power is rectified. Preferably, AC electrical power delivered at the electrical conductors may be rectified to DC electrical power delivered to the driver circuit. The driver circuit may serve to supply electrical power to the LED element as suited for lighting operation thereof, e. g. regulate voltage, current or power.

The electrical conductor that in case of a defect is severed by the separation device may be connected between the electrical terminals and the rectifier circuit. Alternatively, the electrical conductor may be provided between the rectifier circuit and the LED element. In both cases, separation of the electrical conductor inhibits further operation of the LED element. Providing the breakage zone of the electrical conductor between an electrical terminal and the rectifier circuit serves to disable this circuit as well.

Any type of detector element may be used which is suited to signal a defect of the cover member. In one preferred embodiment, the detector element may include at least one conductive track provided on a breakable substrate, such as a plastic member or glass member. The breakable substrate may either be part of the cover member, or it may be provided in close mechanical contact with the cover member. Thus, if forces or deformations act on the cover member which may lead to a defect, the breakable substrate may break and thus interrupt the conductive track, such that the cover member defect is electrically sensed. In preferred embodiments, the breakable substrate may be provided in elongated form, e. g. as a bar of round or rectangular cross-section, as an elongated flat cover over the LED element, or as a tube within which the LED element is provided.

These and other aspects of the invention will become apparent from and elucidated with reference to the embodiments described hereinafter.

DESCRIPTION OF EMBODIMENTS

Figure 1:
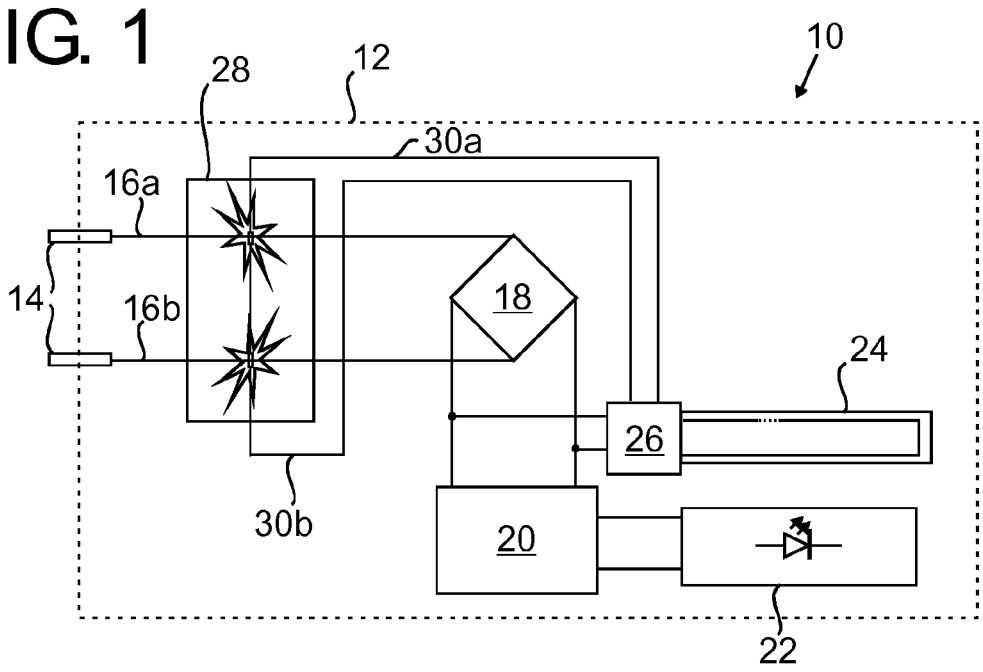
FIG. 1 shows a circuit diagram of a first embodiment of an LED lamp.

FIG. 1 shows a circuit diagram of a first embodiment of an LED lamp 10 including a housing 12 from which electrical terminals 14 project. If the LED lamp 10 is installed in a lighting fixture, electrical operating power is supplied at the terminals 14, such as by a mains connection.

The terminals 14 are electrically connected by conductors 16*a*, 16*b* to a rectifier 18, which rectifies AC electrical power and provides DC electrical power to a driver circuit 20.

The driver circuit 20 supplies regulated operating power to an LED element 22 shown only symbolically.

The LED lamp 10 includes a safety device comprised of a detector element 24, a safety circuit 26 and a separation device 28. The detector element 24 is connected to the safety circuit 26 and serves to electrically detect a defect of a housing 12. The safety circuit 26 is electrically connected through triggering conductors 30*a*, 30*b* to the separation device 28 to trigger the separation device if a defect of the housing 12 is detected. The separation device 28 is provided to mechanically server the electrical conductors 16*a*, 16*b* if triggered.

Figure 7:
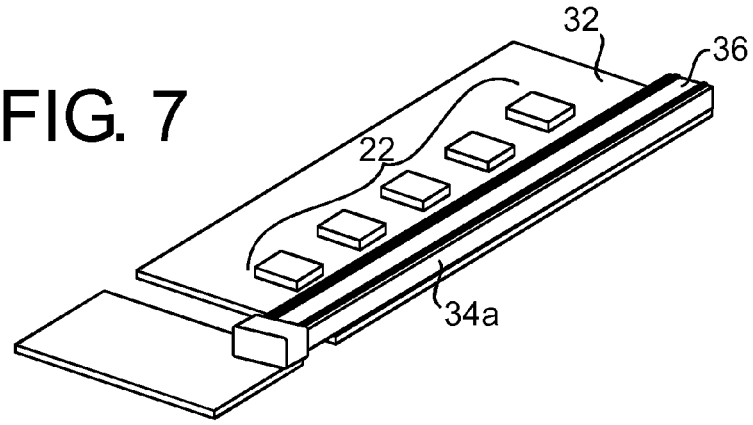
FIGS. 7-9 show perspective views of parts of LED lamp embodiments with different detector elements.
Figure 8:
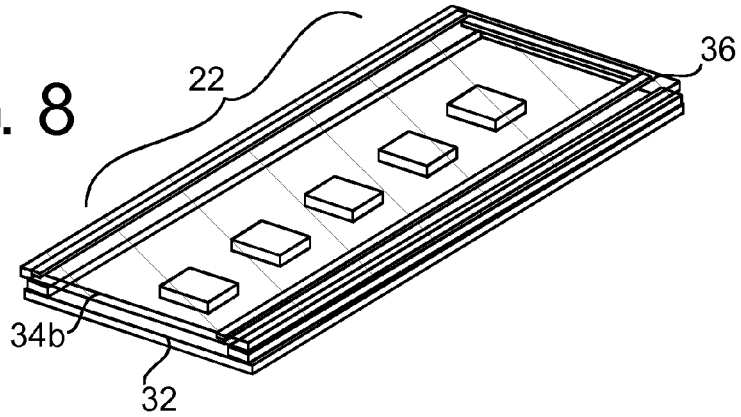
Figure 9:
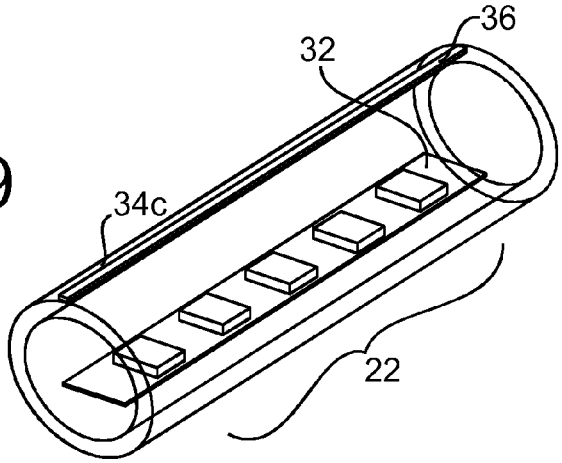

Different embodiments of the detector element 24 and its arrangement relative to the LED element 22 are possible. Examples are shown in FIGS. 7-9. In each of these embodiments, an electrical conductor track 36 is provided on a breakable substrate, preferably glass. If forces and deformations act on the lamp housing 12, the glass substrate breaks and the conductor track 36 is interrupted, which is electrically detected by the safety circuit 26.

In the embodiments of FIGS. 7-9, the LED element 22 is in each case provided as a plurality of light emitting diodes arranged on a circuit board 32. The breakable substrate in the embodiment of FIG. 7 is a glass bar 34*a* arranged next to the LED element 24, so that it will break if the circuit board 32 is broken or deformed.

In the embodiment of FIG. 8, the breakable substrate is a flat glass cover plate 34*b* provided above the LED element 24, such that it will also break if the lamp is deformed. In the embodiment of FIG. 9, the breakable substrate is a glass tube 34*c* provided around the LED element 24.

In each of the above embodiments, conductive tracks 36 provided on the breakable substrate will be interrupted if the substrate 34*a*, 34*b*, 34*c* breaks. As a still further embodiment, the LED element 24 may be mounted on a breakable circuit board, e.g. made of glass, also comprising a conductive track 36, which is interrupted if the circuit board breaks.

Back in FIG. 1, the safety circuit 26 monitors conductivity of the conductive track 36 of the detector element 24. In case the conductive track 36 is interrupted, this signals a potential defect of the housing 12. In this situation, the safety circuit 26 acts to permanently disable further operation of the lamp 10.

This is effected by sending an electrical triggering signal through the triggering conductors 30*a*, 30*b* to the separation devices 28. As will be explained below, the separation device 28 mechanically severs the electrical conductors 16*a*, 16*b*, and thus permanently disables the lamp 10.

Figure 2:
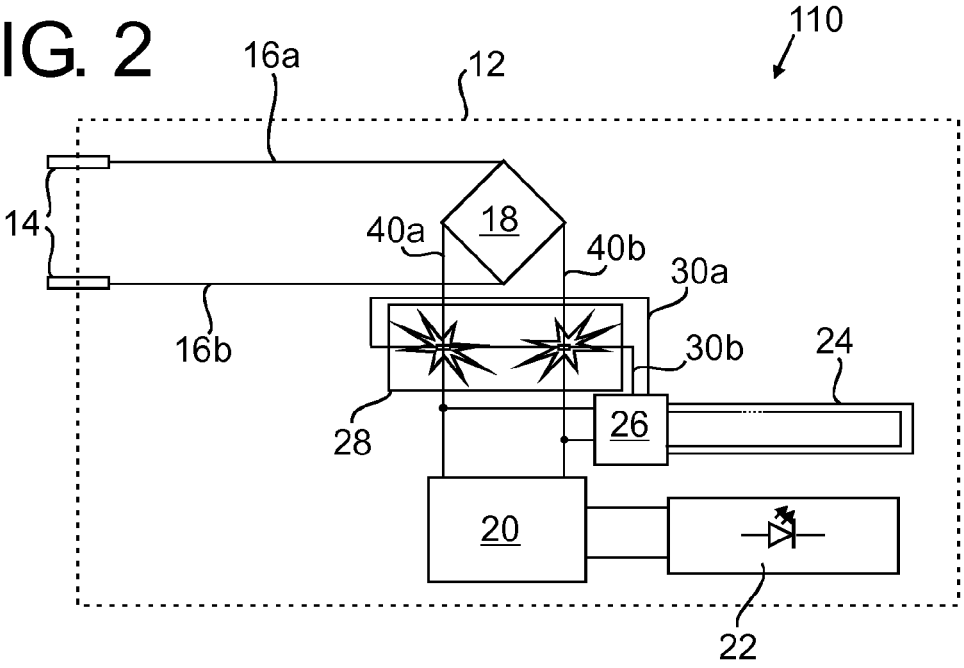
FIG. 2 shows a circuit diagram of a second embodiment of an LED lamp.

FIG. 2 shows a circuit diagram of a second embodiment of an LED lamp 110. The circuit of the lamp 110 according to the second embodiment is in many ways similar to the first embodiment. Like parts are designated by like reference numerals. In the following, only the differences between the first and second embodiment will be explained.

While in the first embodiment of the lamp 10 the separation device 28 is arranged at the electrical conductors 16*a*, 16*b* arranged between the supply terminals 14 and the rectifier 18, the separation device 28 is arranged in a different position of the same circuit. Electrical conductors 40*a*, 40*b* are provided to connect the rectifier 18 to the driver circuit 20. The separation device 28 is arranged at these electrical conductors 40*a*, 40*b* to disconnect them if triggered.

In both the first and second embodiment, all (two) poles of the electrical power supply are interrupted by the separation device 28.

Also, in both embodiments the safety circuit 26 is supplied with electrical operating power from the rectified input voltage. The triggering signal from the safety circuit 26 to the separation device 28 is supplied via triggering conductors 30*a*, 30*b* electrically isolated from the electrical conductors 16*a*, 16*b*; 40*a*, 40*b* in the supply line from the terminals 14 to the LED element 22.

In the following, different embodiments of the separation device 28 will be described with reference to the drawings FIG. 3-FIG. 6*c*.

Figure 3:
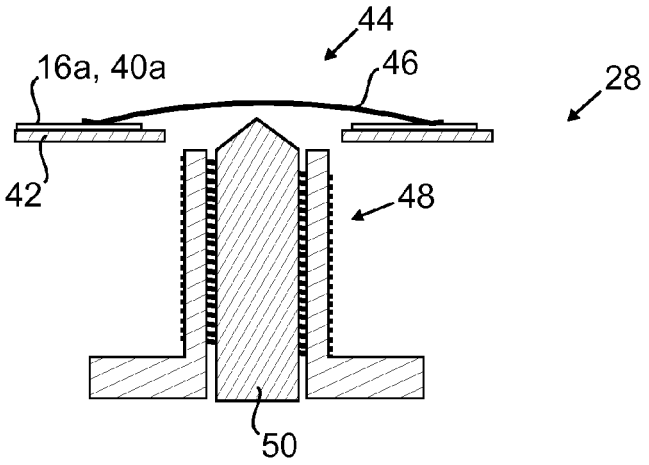
FIG. 3 shows a schematical side view of a first embodiment of a separation device.

FIG. 3 shows in a schematical side view a first embodiment of a separation device 28. The electrical conductor, which may be the electrical conductor 16*a* according to the first embodiment or the electrical conductor 40*a* according to the second embodiment, is provided as a conductive track on a printed circuit board 42. The conductive track is interrupted at a breakage zone 44 which is provided at a position where the electrical conductor 16*a*, 40*a* should be interrupted in case of a housing defect. Within the breakage zone 44, the electrical conductor is provided as a bond wire 46.

Proximate to the bond wire 46, a coil 48 is provided with a piston 50. The piston 50 is comprised of ferromagnetic material, and preferably includes a permanent magnet. At least the tip is electrically insulated to avoid conduction by the piston 50. The triggering signal provided by the safety circuit 26 is applied to the coil 48, which generates a magnetic field that propels the ferromagnetic piston 50, such that the sharpened tip thereof cuts through the bond wire 46 and thus mechanically severs it. As a consequence, the electrical conductor 16*a*, 40*a* is permanently interrupted.

Figure 4A:
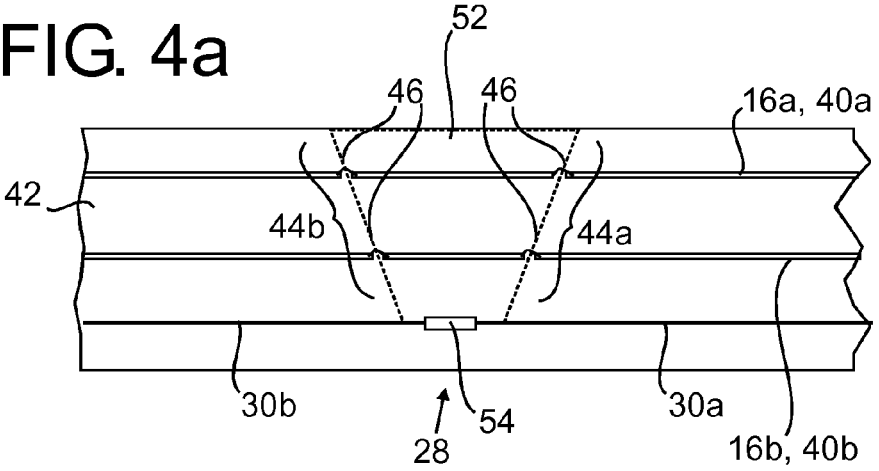
FIGS. 4*a*, 4*b* show a top view and a perspective view of a second embodiment of a separation device.
Figure 4B:
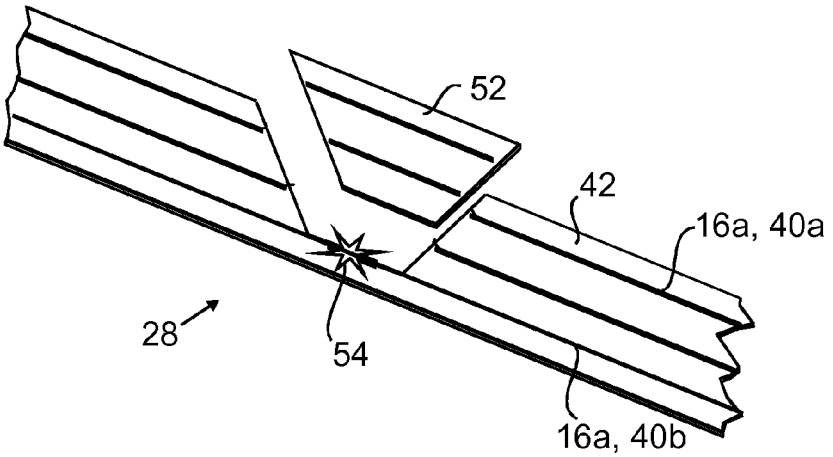

FIGS. 4*a*, 4*b* show a second embodiment of a separation device 28. The electrical conductors 16*a*, 16*b* (or: 40*a*, 40*b*) are provided on a circuit board 42 and are each interrupted in two consecutive breakage zones 44*a*, 44*b*, where bond wires 46 are provided. The circuit board 42 comprises a cutout element 52 only loosely connected to the rest of the circuit board 42. A chemical charge 54 is provided with an ignition contact connected to the triggering conductors 30*a*, 30*b*.

The chemical charge 54 may be any combustible material, which, if ignited, is able to rapidly expand and thus produce a propelling force. For example, the chemical charge 54 may a fluid or solid, which upon ignition is rapidly turned into a gas. In particular, the material may be enclosed in a cavity, piston or otherwise confined to achieve a directed force. An example of a combustible solid, which is safe (i.e. protected against spontaneous ignition) may be for example paraffin as used in household matches.

Different electrical components may be used as ignition for the chemical charge 54, such as e. g. a glow-wire or filament, for example made of tungsten, gold, silver, aluminum, carbon etc. In a particularly preferred embodiment, a simple resistor, such as an SMT resistor may be used as ignition source for a pyrotechnic chemical charge 54, such as paraffin. When producing the lamp with a chemical charge 54, it may be advisable to apply the material of the chemical charge 54 after a soldering step to avoid ignition during the manufacturing process.

In normal operation, electrical operating power is conducted through the conductors 16*a*, 16*b*; 40*a*, 40*b*.

In case of a detected housing defect, the safety circuit 26 sends a triggering signal through triggering conductors 30*a*, 30*b*, such that the ignition element of the explosive charge 54 is activated. This sets off the charge 54 arranged between the cutout element 52 and the rest of the circuit board 42. The mechanical force generated by the explosion separates the cutout 52 from the rest of the circuit board 42 as shown in FIG. 4*b*. As the cutout 52 is separated from the rest of the circuit board 42, the bond wires 46 are ripped apart in each of the breakage zones 44*a*, 44*b*. Thus, each of the conductors 16*a*, 40*a*; 16*b*, 40*b* is mechanically severed at two consecutive positions, leading to safe interruption of any further conduction.

Figure 5A:
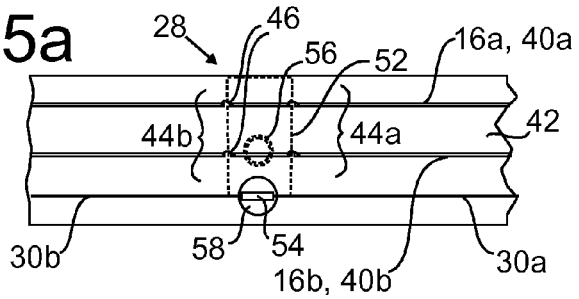
FIGS. 5*a*, 5*b* show a top view and a perspective view of a third embodiment of a separation device.
Figure 5B:
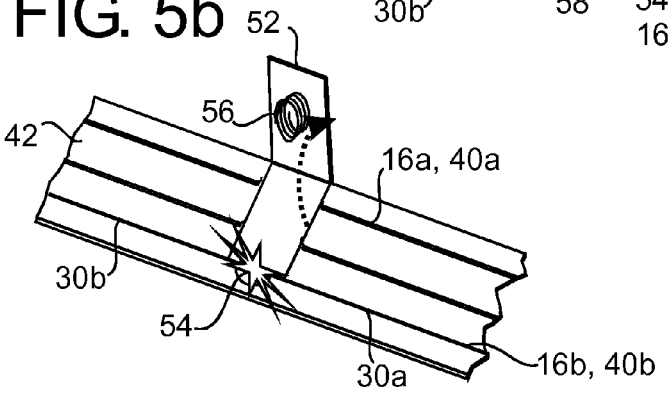

FIGS. 5*a*, 5*b* show a third embodiment of a separation device 28. The third embodiment closely resembles the above described second embodiment according to FIGS. 4*a*, 4*b*. Like reference numerals refer to like parts. In the following, only differences will be explained. As in the second embodiment according to FIGS. 4*a*, 4*b*, the electrical conductor 16*a*, 40*a*; 16*b*, 40*b* are provided on a circuit board 42 with a cutout 52, and two breakage zones 44*a*, 44*b* are arranged at the borders of the cutout 52. Triggering conductors 30*a*, 30*b* are connected to a chemical charge 54.

Differently from the second embodiment, the cutout 52 in the third embodiment according to FIGS. 5*a*, 5*b* is pivotably mounted to the rest of the circuit board 42, and a compressed spring 56 is arranged below it. A seal 58 holds the cutout 52 in place against the spring force.

If a triggering signal is send through triggering conductors 30*a*, 30*b* and the chemical charge 54 is set off, this removes the seal 58, setting the cutout 52 free. Under the force of the compressed spring 56, the cutout 52 pivots as shown in FIG. 5*b*, thereby severing the bond wires 46 arranged in the breakage zones 44*a*, 44*b*.

Figure 6A:
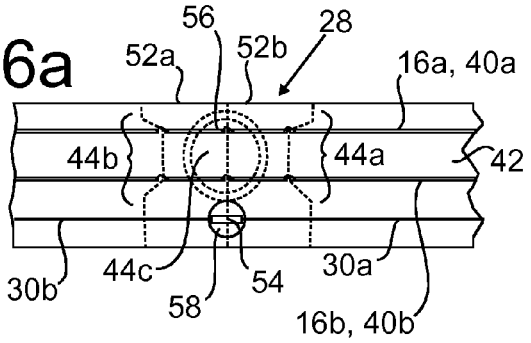
FIGS. 6*a-c* show a top view, perspective view and side view of a fourth embodiment of a separation device.
Figure 6B:
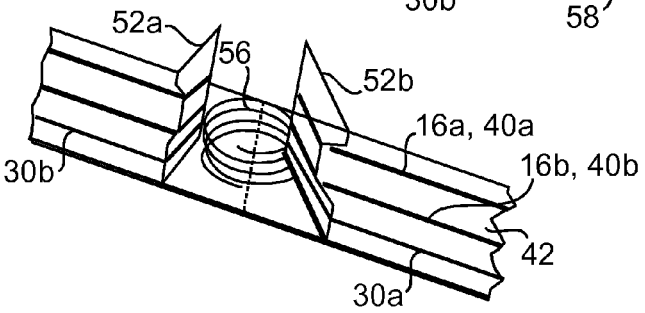
Figure 6C:
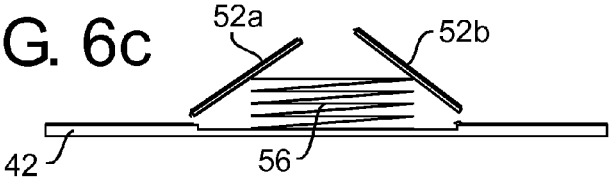

FIGS. 6*a*-6*c* show a fourth embodiment of a separation device 28. The fourth embodiment closely resembles the above described third embodiment according to FIGS. 5*a*, 5*b*. Like reference numerals refer to like parts. In the following, only differences will be explained.

According to the fourth embodiment, a first pivotable cutout 52*a* and a second pivotable cutout 52*b* are provided, loaded by a compressed spring 56 underneath. The cutouts 52*a*, 52*b* are held together by a seal 58 to which a chemical charge 54 with an ignition is fixed. Three consecutive breakage zones 44*a*, 44*b*, 44*c* are formed in each of the electrical conductors 16*a*, 40*a*; 16*b*, 40*b* by bond wires.

As the charge 54 is ignited, the seal 58 is removed and the cutouts 52*a*, 52*b* pivot like opening doors (FIG. 6*b*), thereby severing the bond wires in each of the breakage zones 44*a*, 44*b*, 44*c*.

The invention has been illustrated and described in detail in the drawings and foregoing description. Such illustration and description are to be considered illustrative or exemplary and not restrictive; the invention is not limited to the disclosed embodiments.

For example, any of the disclosed circuit arrangements, embodiments of separation devices and embodiments of detection devices may be arbitrarily combined. While the disclosed all-pole disconnection is preferred, it is alternatively also possible to disconnect only one pole, which would suffice to prohibit further operation of the LED element 22.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A method of operating a lamp, comprising:

detecting a defect of a cover member covering an electrical circuit including an LED element; and in response to detecting said defect of the cover member, mechanically acting upon material of an electrical conductor through which electrical power is supplied to the LED element so as to permanently physically separate one part of the material from an other part of the material such that no further electrical conduction of the electrical power to the LED element is possible through the electrical conductor.

2. The method of claim 1, wherein mechanically acting upon the material of the electrical conductor so as to permanently physically separate the one part of the material from the other part of the material comprises cutting through the material with a sharpened tip of a ferromagnetic piston.

3. The method of claim 1, wherein mechanically acting upon the material of the electrical conductor so as to permanently physically separate the one part of the material from the other part of the material comprises igniting an explosion of a chemical charge to produce a mechanical force which physically separates the one part of the material from the other part of the material.

4. A device, comprising:

a light emitting diode (LED);

an electrical conductor connected to the LED and configured to supply electrical power to the LED;

a cover member covering the LED;

a detector configured to detect a defect in the cover member and in response to a detected defect to produce a triggering signal; and a separation device configured to receive the triggering signal and, in response to the triggering signal indicating the detected defect in the cover member, to mechanically act upon material of the electrical conductor so as to permanently physically separate one part of the material from an other part of the material such that no further electrical conduction of electrical power to the LED element is possible through the electrical conductor.

5. The device of claim 4, wherein the separation device comprises a ferromagnetic piston having a sharpened tip which is configured to cut through the material of the electrical conductor in response to the triggering signal.

6. The device of claim 4, wherein the electrical conductor is provided on a first carrier part and on a second carrier part, and wherein the separation device comprises a chemical charge which is configured in response to the triggering signal to explode to physically separate the first carrier part from the second carrier part.

7. The device of claim 4, wherein the detector comprises an electrical track on a breakable substrate, wherein the breakable substrate is broken and the electrical track is interrupted in response to the defect in the cover member.

* * * * *